United States Patent [19]

Gauvain

[11] Patent Number: 4,575,903

[45] Date of Patent: Mar. 18, 1986

[54] DEVICE FOR GUIDING A SLIVER INTO A CAN COILER

[75] Inventor: Roger Gauvain, Buhl, France

[73] Assignee: Societe Alsacienne de Construction de Material Textile, France

[21] Appl. No.: 552,978

[22] Filed: Nov. 17, 1983

[30] Foreign Application Priority Data

Dec. 13, 1982 [FR] France ..... 82 20831

[51] Int. Cl.[3] ..... D04H 11/00; D01H 5/72

[52] U.S. Cl. ..... 19/159 R; 19/288

[58] Field of Search ..... 19/159 R, 288, 289, 19/290, 291, 292

[56] References Cited

U.S. PATENT DOCUMENTS

| | | | |
|---|---|---|---|
| 3,035,313 | 5/1962 | Naegeli | 19/288 |
| 3,377,665 | 4/1968 | Kincaid | 19/159 R |
| 3,736,625 | 6/1973 | Johns | 19/159 R |
| 4,318,206 | 3/1982 | Ferri | 19/159 R |
| 4,372,010 | 2/1983 | Gauvain | 19/288 X |

*Primary Examiner*—Louis K. Rimrodt

*Attorney, Agent, or Firm*—Cantor and Lessler

[57] ABSTRACT

A web of fibers delivered from a drawing machine is assembled into a sliver which passes into a guide duct, then passes between takeup rollers into a can coiler. Downwardly inclined air-escape holes are pierced in the wall of the guide duct in order to discharge the air entrained by the sliver. There is consequently no swelling of the sliver on the delivery side of the takeup rollers and no pressure rise towards the guide duct inlet, thereby facilitating the introduction of the web into the duct.

2 Claims, 1 Drawing Figure

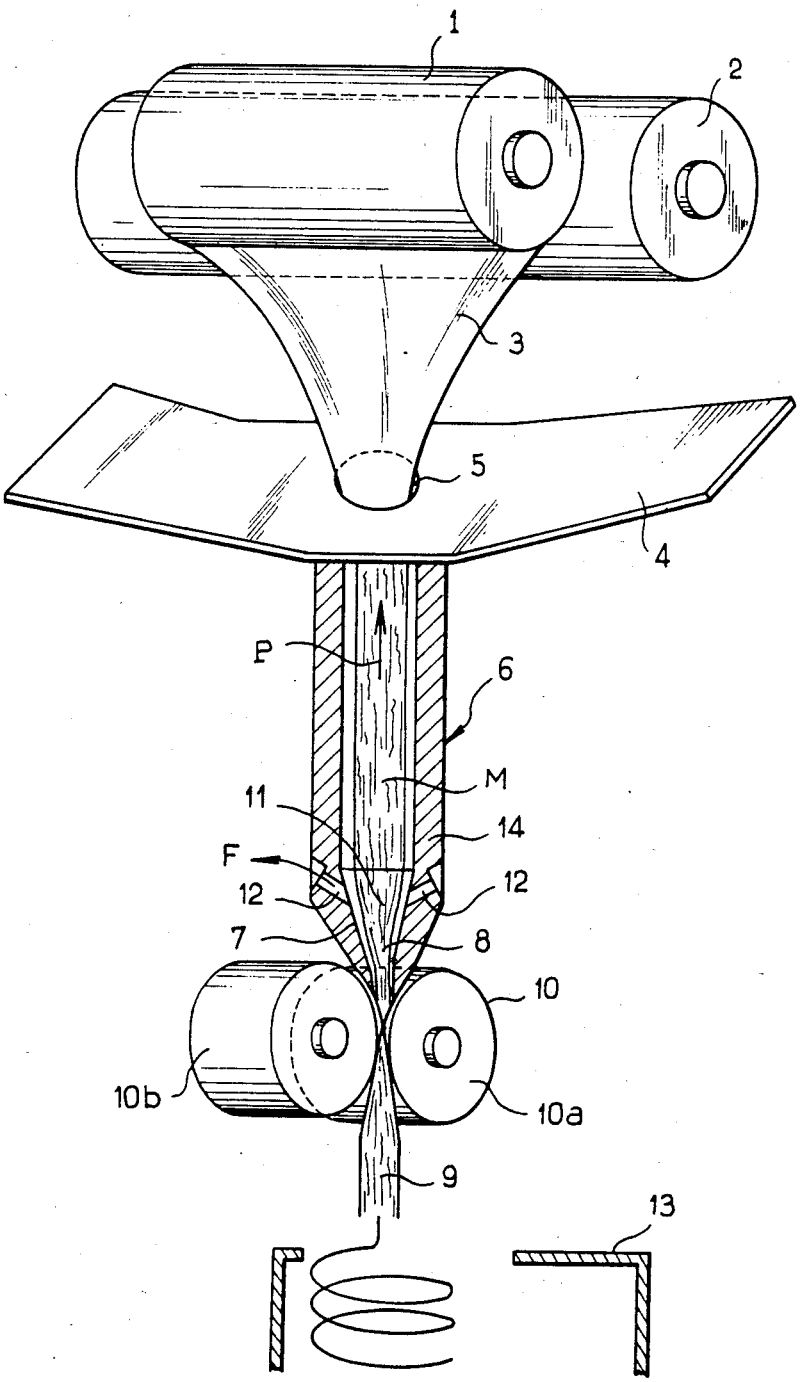
1
2
3
5
4
P
6
M
11
14
F
12
12
7
8
10
10b
10a
9
13

DEVICE FOR GUIDING A SLIVER INTO A CAN COILER

This invention relates to the textile industry and is more particularly directed to a device for high-speed guiding of a web of textile fibers and for the formation of a sliver within a guide duct prior to introduction into a can coiler.

It is well known that, after the last stage of the drawing system, a drawing machine is equipped with a deflector or a funnel for assembling the drawn-out web into a sliver which is guided within a duct, then discharged into a free space over a short distance prior to entry into a cone-shaped throttling guide. The guide terminates in a small opening which serves to condense the sliver. At the exit of the guide, two cylinders having the function of takeup rollers transfer the sliver to a can coiler in a known manner.

In high-draft, high-speed drawing machines, the web produced is extremely thin and tenuous, with the result that it is very fragile.

In order to ensure wholly satisfactory operation of these machines, it proves necessary to guide the sliver on its path of travel from the entrance of the deflector to the delivery side of the takeup rollers without any interruption of the guide duct as described in the foregoing. In consequence, the rate of travel of the sliver is such that the air thus entrained cannot escape freely and thus produces a pressure rise within the guide duct, part of the air being driven back through the deflector orifice. At this point, however, the sliver has not yet been either formed or guided and consequently explodes. Moreover, on the delivery side of the two takeup rollers, part of the turbulent flow of entrained air causes reswelling of the sliver, which is not recommended for the remaining sequence of operations.

The aim of the present invention is to overcome these disadvantages.

The invention has for its object a device located downstream of a high-draft drawing machine and upstream of a can coiler for high-speed transfer of a fiber web which is guided within a duct in order to form a sliver which, at the exit of said guide duct, passes between takeup rollers of the can coiler. Said device is distinguished by the fact that the wall of said guide duct is pierced with at least one air-escape hole which opens to the surrounding atmosphere and makes it possible for the air entrained by the interstices of the fibers to be discharged to the exterior in order to prevent any pressure rise within the guide duct which would otherwise set up an obstacle to the admission of the web of fibers into the entrance of the guide duct.

In the most common case in which the guide duct terminates in a throttled portion for condensing the sliver, the air-escape hole or holes are preferably formed in the wall of the guide duct in proximity to the throttled internal wall of said duct at the point which produces a condensing action on the sliver and which corresponds to maximum air turbulence.

In a preferred embodiment of the invention, the holes are inclined from the exterior of the guide duct towards the interior in the direction of travel of the sliver.

Machines in which holes are formed in the wall of the guide duct are already known. But these holes serve either to blow compressed air (in order to initiate the introduction of the web into the guide duct with greater ease) or to mount measuring or regulating instruments.

In the prior art, no provision has been made for holes which serve to discharge air from the interior of the guide duct to the surrounding atmosphere.

By causing air which is entrained by the sliver and occluded in this latter to be discharged upstream of the takeup rollers, the invention also makes it possible to reduce swelling of the sliver on the delivery side of the two takeup rollers, with the result that a greater length of sliver can be coiled into the same can.

These and other features of the invention will be more apparent to those skilled in the art upon consideration of the following description and accompanying FIGURE which is a part-sectional view in perspective showing one embodiment of the device in accordance with the invention.

The rollers 1 and 2 represent the last stage of the drawing system of a machine. The fibers are delivered in the form of a web 3 which, in the case of a high-draft machine, is extremely tenuous and fragile. This web is applied against a deflector 4 and has to be condensed into a sliver in order to pass through an orifice 5 into a duct 6. Said duct guides the sliver M towards the cone-shaped throttling exit 7 which terminates in an opening 8 for the passage of the condensed sliver 9. After delivery from the guide duct, said condensed sliver passes between the drafting wheels 10 formed by the pair of cylinders 10*a*, 10*b* which have the design function of takeup rollers for transferring the condensed sliver to a conventional can coiler as shown diagrammatically in the figure and designated by the reference 13.

When the drawing machine rotates at its production speed, the web 3 which passes through the orifice 5 of the deflector 4 entrains the air contained within the interstices of the fibers along the guide duct 6 up to the level at which the throttled section 11 produces a pressure rise P and very high turbulence, thereby having the effect at the same time of setting up a resistance to the web 3 and to the sliver as this latter arrives from the deflector 4.

In accordance with the invention, there are formed in the wall 14 of the guide duct 6 one or a number of air-escape holes 12 which open to the surrounding atmosphere. These holes permit discharge of air (in the direction of the arrow F) while preventing any pressure rise P within the guide duct 6 and disintegration of the web 3 at the level of the orifice 5 of the deflector 4.

In the case illustrated in the FIGURE in which the guide duct 6 terminates in a throttled zone 7, the air-escape holes 12 are advantageously formed in close proximity to said throttled zone in which turbulent airflow is at a maximum.

In the event that the guide duct 6 has a substantially constant cross-section over its entire length and has a tapered end portion which is adapted to fit in position between the takeup rollers or else in the event that the guide duct 6 has a progressively decreasing cross-section, the air-escape holes 12 can be formed at any desired point of the flow path in the guide duct 6.

Since the pressure of air contained within the sliver has a tendency to rise as indicated by the arrow P in the FIGURE, it is an advantage to ensure that the hole or holes 12 are inclined from the exterior towards the interior of the guide duct in the direction of travel of the sliver M.

The device in accordance with the invention has a further advantage in that it prevents swelling of the condensed sliver 9 as this latter is delivered by the two takeup rollers 10*a* and 10*b*, with the result that a greater length of sliver can be coiled into the same can.

The air-escape holes 12 which are inclined in the direction of travel of the sliver (as shown in the FIGURE) are particularly advantageous in the case of a high-speed drawing machine. It has in fact been observed that, if an air-escape hole 12 is oriented at right angles to the direction of travel of the sliver, the diameter of said hole must be limited in order to prevent the fibers from catching on the periphery of the hole. Air-escape holes which are thus limited to a small diameter are consequently liable to be clogged with fibers entrained by the air which is intended to escape through the holes.

On the contrary, an inclined hole which slopes downwards in the direction of travel of the sliver does not offer any resistance to the flow of fibers since there is no sharp edge located at right angles to the direction of flow. By virtue of this inclination, the diameter of the air-escape holes can be increased without any attendant danger of catching of the fibers or of clogging of the hole with fibers.

The preferred angle of slope is in the vicinity of 60° with respect to the axis of travel of the sliver as shown in the FIGURE but this angle may be reduced to the minimum limit at which machining operations still remain possible.

What is claimed is:

1. A device located downstream of a high-draft drawing machine and upstream of a can coiler for high-speed transfer of a fiber web which is guided within a guide duct in order to form a sliver which passes at the exit of said duct between takeup rollers of the can coiler, the wall of said guide duct being pierced with at least one air-escape hole which opens to the surrounding atmosphere and makes it possible for the air entrained by the interstices of the fibers to be discharged to the exterior in order to prevent any pressure rise within the guide duct which would otherwise set up an obstacle to the admission of the web of fibers into the entrance of said guide duct, wherein the air-escape hole is inclined from the exterior of the guide duct to the interior in the direction of travel of the sliver.

2. A device according to claim 1 in which the guide duct terminates in a throttled portion for condensing the sliver, wherein the aforesaid air-escape hole is formed within the throttled zone of said guide duct.

* * * * *